US007085199B2

(12) United States Patent
Lang

(10) Patent No.: US 7,085,199 B2
(45) Date of Patent: Aug. 1, 2006

(54) WATCH MOVEMENT

(75) Inventor: Gerd-Rüdiger Lang, Münich (DE)

(73) Assignee: Chronoswiss Uhren GmbH (DE)

( * ) Notice: Subject to any disclaimer, the term of this patent is extended or adjusted under 35 U.S.C. 154(b) by 268 days.

(21) Appl. No.: 10/472,371

(22) PCT Filed: Feb. 27, 2002

(86) PCT No.: PCT/IB02/00591

§ 371 (c)(1),
(2), (4) Date: Sep. 17, 2003

(87) PCT Pub. No.: WO02/075460

PCT Pub. Date: Sep. 26, 2002

(65) Prior Publication Data

US 2004/0105346 A1 Jun. 3, 2004

(30) Foreign Application Priority Data

Mar. 21, 2001 (EP) ..... 01107013

(51) Int. Cl.
*G04B 19/02* (2006.01)
*G04B 19/06* (2006.01)
*G04B 19/04* (2006.01)

(52) U.S. Cl. ..... 368/220; 368/324

(58) Field of Classification Search ..... 368/80, 368/101, 110, 113, 220, 223, 322, 323, 324
See application file for complete search history.

(56) References Cited

U.S. PATENT DOCUMENTS

| | | | | |
|---|---|---|---|---|
| 1,298,353 | A * | 3/1919 | Kish | 368/220 |
| 2,559,461 | A * | 7/1951 | Pichette | 384/230 |
| 3,903,686 | A * | 9/1975 | Burki | 368/106 |
| 4,748,603 | A * | 5/1988 | Ray et al. | 368/80 |
| 5,278,807 | A * | 1/1994 | Mathys | 368/140 |
| 5,793,708 | A * | 8/1998 | Schmidt et al. | 368/106 |

FOREIGN PATENT DOCUMENTS

JP 57-128873 8/1982

* cited by examiner

*Primary Examiner*—Kamand Cuneo
*Assistant Examiner*—Jeanne-Marguerite Goodwin
(74) *Attorney, Agent, or Firm*—McGlew & Tuttle, PC

(57) ABSTRACT

Watch movement comprising a housing (26, 28, 30, 32, 34) and a gear train, formed from a series of spindles (36, 38, 40, 42), pivotably mounted on the housing, of which a first of said spindles (42) is provided with a shank (42*a*), for fixing a first hand (16) and a second of said spindles (50) is provided with a cylinder (50*b*), arranged co-axially to said shank, for fixing a second hand (20). According to the invention, the second spindle (50) is rotationally mounted on said housing (34) by means of a ball bearing (54).

20 Claims, 2 Drawing Sheets

WATCH MOVEMENT

BACKGROUND OF THE INVENTION

The present invention relates to watch movements of the type including a frame and a gear train formed of wheel sets pivotably mounted on the frame. In this movement, a first of the wheel sets is provided with a shank for receiving a first hand, whereas a second of the wheel sets is provided with a pipe disposed coaxially with the shank and intended to receive a second hand. Practically all watches with hand displays have these features.

Their movement includes more precisely a motion work, formed of a cannon pinion, a minute wheel set and an hour wheel. This motion work ensures a division by twelve. The cannon pinion is friction mounted on a minute wheel set, completing one revolution per hour. Its end is provided with a shank onto which it is possible to drive a hand, for displaying the minutes.

The hour wheel is provided with a pipe mounted so as to rotate freely on the cannon pinion. It completes one revolution in twelve hours the same direction as the cannon pinion, and it carries a hand for displaying the hours.

The superposition of two wheel sets rotating at different speeds necessarily involves significant friction, which can, however, be accepted when the relative movements of the wheel sets are slow.

However, in certain applications, in which the rotational speed can reach one revolution per minute, for example, it is important to reduce losses through friction to a minimum.

SUMMARY OF THE INVENTION

It is an object of the present invention to reduce these losses. The movement according to the invention is thus characterised in that the second wheel set is mounted, so as to rotate, on the frame by means of a ball bearing.

Advantageously, the bearing includes a core, a ring and balls arranged between the core and the ring, the ring being rigidly fixed to the frame and the core to the second wheel set, for example forcibly, by being driven onto the pipe.

Such a solution has a particular advantage when the second wheel set, when it is moving, is animated by a greater angular velocity than that of the first wheel set.

This is particularly the case when the movement includes a chronograph type mechanism with a chronograph gear train including a wheel set for the seconds, formed by the second wheel set.

In a particular embodiment, the gear train of the movement includes a wheel set for the seconds, completing one revolution per minute, whereas the movement further includes:

- a coupling device capable of occupying first and second positions and fitted with an intermediate wheel arranged on the coupling device and kinematically connecting the wheel set for the seconds to the second wheel set when the coupling device occupies the second position, and
- control means for moving the coupling device from one position to the other.

Owing to this particular configuration, it is possible to place the chronograph mechanism on the side of the movement that is arranged to receive the hands. Consequently, the wheel sets of this mechanism do not have to pass right through the movement. It is thus easier to make a complementary module on the basis of an existing movement.

BRIEF DESCRIPTION OF THE DRAWINGS

Other advantages and features of the invention will appear from the following description, made with reference to the annexed drawings, in which.

DESCRIPTION OF A PREFERRED EMBODIMENT

In the following description, the positions of the different components arranged on and facing the watch dial are defined with reference to the position that an hour hand, rotating on an axis passing through the centre of the dial, would occupy.

Figure 1:
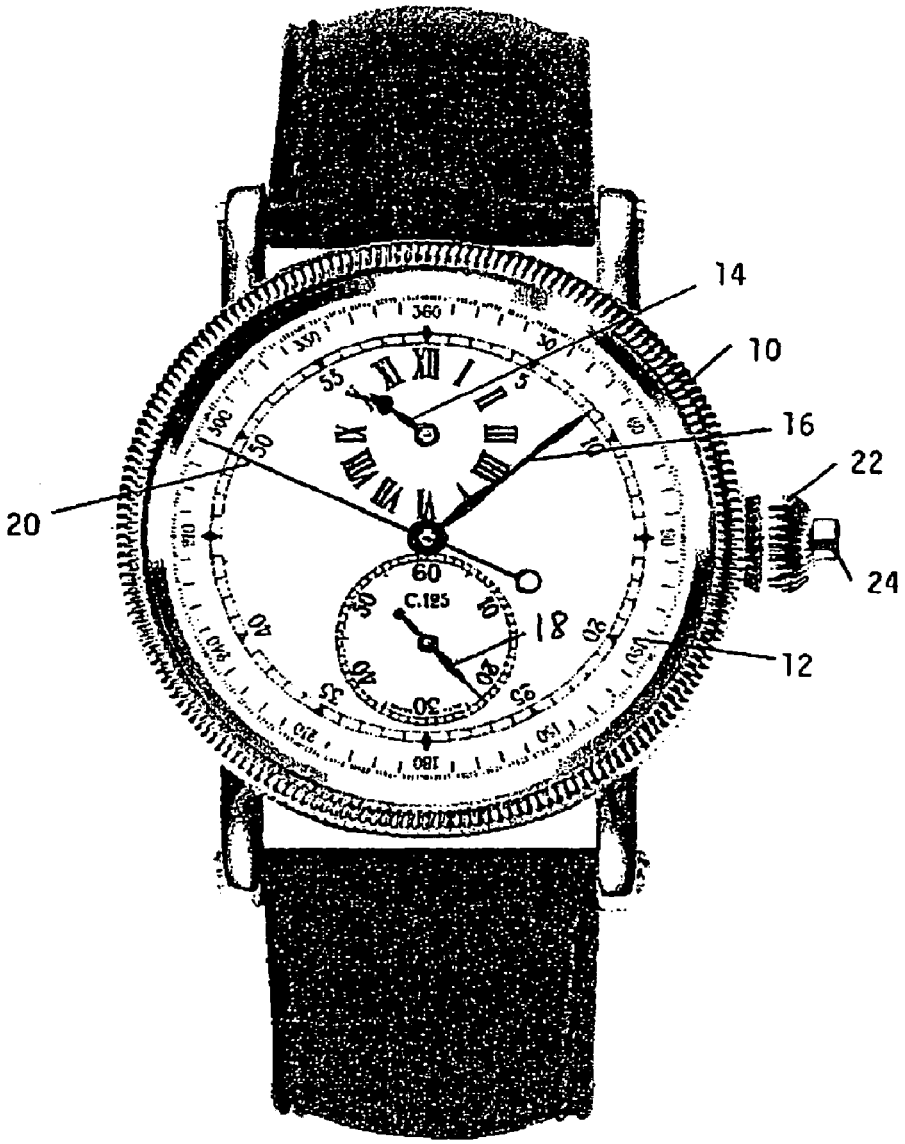
FIG. 1 shows a watch fitted with a movement according to the invention.

The watch shown in FIG. 1 includes a case 10 defining a housing in which a watch movement is arranged, which will be described with reference to FIG. 2. This movement includes a round dial 12 and hands for the hours 14, minutes 16, seconds 18 and chronograph seconds 20. It is controlled by a crown 22 arranged at three o'clock and by a push-button 24 coaxial with crown 22.

In this watch, the hour hand 14 and seconds hand 18 are off-centre, respectively arranged at midday and six o'clock. The minute hand 16 and chronograph seconds hand 20 are coaxial with the dial.

Figure 2:
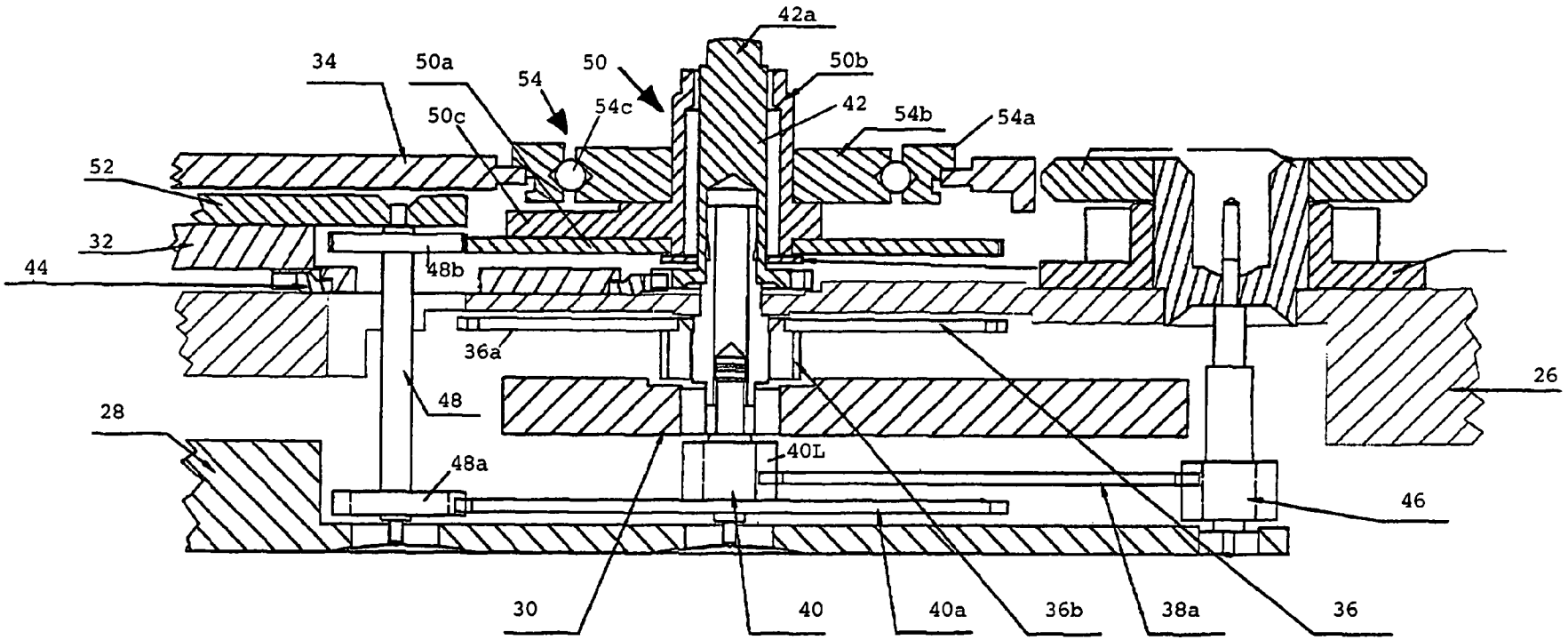
FIG. 2 shows, in cross-section, a part of a movement according to the invention.

As can be seen most particularly in FIG. 2, the movement includes a frame, formed of a plate 26, bridges, particularly a train bridge 28, a centre bridge 30, a minute bridge 32 and a chronograph bridge 34, this frame being used as a support for the various mobile parts of the movement.

This movement includes a power source powering a balance via a going train including centre wheel set 36, third wheel set 38 and centre seconds wheel set 40, and an escapement which has not been shown because is does not form part of the invention. These wheel sets each include a wheel identified by the reference a and a pinion bearing the reference b.

Centre wheel 36 carries a cannon pinion 42, friction mounted and provided with a shank **42*a* for carrying minute hand 16, and which forms the first wheel set of a motion work. The latter further includes an intermediate wheel 44 meshing with a minute wheel set, which co-operates with an hour wheel carrying hour hand 14**. The minute wheel set and the hour wheel are not visible in the drawing.

The gear train of this movement further includes a small seconds pinion 46, an oscillating pinion 48 and a chronograph seconds wheel 50. The small seconds pinion is meshed with the third wheel **38*a*. It is for carrying seconds hand 18**.

Oscillating pinion 48 is provided with two sets of teeth, respectively identified by the letters a and b and respectively meshing with seconds wheel **40*a* and chronograph seconds wheel 50. It is mounted in bearings of train bridge 28 and a lever 52. The latter is secured to plate 26, on which it can pivot, and controlled by a chronograph mechanism, which will not be described in detail, since it is well known to those skilled in the art and it is itself actuated by push-button 24**.

When lever 52 pivots, it drives the pivot of pinion 48 sideways, such that, depending upon the direction of movement, its toothing **48*b* is released from or meshes with the toothing of wheel 50. In other words, pinion 48 and lever 52** together form a coupling device, kinematically connecting or disconnecting the centre seconds wheel 40*a* to chronograph seconds wheel 50.

Chronograph seconds wheel 50 is arranged coaxial with cannon pinion 42. It is formed of a plate identified by the letter a, which meshes with toothing 48*b*, a pipe b, engaged on cannon pinion 42 and carrying chronograph seconds hand 20, and a heart piece c, whose function will be specified hereinafter and which, adjacent to plate 50*a*, is made integral with pipe 50*b*. It is pivotably mounted on chronograph bridge 34 by means of a ball bearing 54. The latter is formed of a ring 54*a* fixed to chronograph bridge 34 by means of a key that is not shown in the drawing, a core 54*b*, driven onto pipe 50*b* and balls 54*c*, arranged in a conventional manner between the ring and the core.

Heart piece 50*c* is intended to co-operate with a hammer, part of the aforementioned chronograph mechanism, which resets the chronograph seconds hand 20 to zero in a manner well known to those skilled in the art.

The watch movement that has just been described can be made from a conventional mechanical watch movement, of the type either displaying the seconds at six o'clock or at the centre. This basic movement is completed by a modified motion work allowing the hour wheel to be arranged at midday and a chronograph module fixed to the basic movement between plate 26 and dial 12. The only significant modification made to the basic movement relates to the addition of oscillating pinion 48, which has to return the movement of seconds wheel 40*a* to the chronograph seconds wheel.

Such a configuration thus only requires minor modifications. It would, however, be a major drawback if chronograph seconds wheel set 50 had to rotate with friction on cannon pinion 42. This would result in significant friction, reducing the amplitude of the balance and, consequently, the precision of the watch. This drawback can be avoided by making wheel 50 pivot on the frame, via ball bearing 54.

The movement as described could be subject to numerous variants, without thereby departing from the scope of the invention. Thus it is entirely possible to envisage making a watch in which the hour hand is concentric to the minute hand. In such case, the hour wheel would be inserted between cannon pinion 42 and chronograph seconds wheel 50.

It would also be possible to associate with the movement other complementary functions other than the chronograph. The presence of a ball bearing as described hereinbefore thus allows superposition of several central hands, the top hand being able to display any function involving a rapid rotational movement, without, however, losses due to friction being too great.

This solution would, of course, also be applicable if several off-centre hands had to be arranged coaxially on the movement.

What is claimed is:

1. A watch movement including:

a frame; and a gear train formed of wheel sets pivotably mounted on said frame, wherein a first of said wheel sets is provided with a shank for receiving a first hand and a second of said wheel sets is provided with a pipe disposed coaxially with said shank and intended to receive a second hand and wherein said second wheel set is rotatably mounted on said frame by means of a ball bearing fittingly maneuverable in a watch.

2. A movement according to claim 1, wherein said bearing includes a core, a ring and balls arranged between said core and said ring, and wherein said ring is rigidly fixed to said frame and said core to said second wheel set.

3. A watch movement according to claim 2, arranged such that said second wheel set, when it is in movement, is animated at a greater angular velocity than that of said first wheel set.

4. A movement according to claim 2, wherein said core is forcibly fixed to said pipe.

5. A watch movement according to claim 4, arranged such that said second wheel set, when it is in movement, is animated at a greater angular velocity than that of said first wheel set.

6. A watch movement according to claim 1, arranged such that said second wheel set, when it is in movement, is animated at a greater angular velocity than that of said first wheel set.

7. A watch movement according to claim 6, including a chronograph type mechanism with a chronograph gear train including a wheel set for the seconds, formed by said second wheel set.

8. A watch movement according to claim 7, wherein said gear train includes said wheel set for the seconds, completing one revolution per minute and further including:

a coupling device capable of occupying a first position and a second position, fitted with an intermediate wheel and kinematically connecting said wheel set for the seconds to said second wheel set when said coupling device occupies said second position, and control means for moving said coupling device from one of said first and second positions to the other position.

9. A movement according to claim 8 wherein said mechanism is disposed on a side of the movement that is arranged for receiving the hands.

10. A watch including a watch movement with reduced friction in a watch case, the watch movement comprising:

a gear train including a wheel set mounted on a train bridge parallel to a plane and including a cannon pinion friction mounted on said wheel set along an axis perpendicular to said plane, said cannon pinion including a shank at its tip to receive a first hand; and a pipe disposed coaxially with said shank to receive a second hand, said pipe fittingly mounted on a ball bearing to rotate freely on said cannon pinion inside the watch case.

11. A watch according to claim 10, wherein said ball bearing includes a core, a ring and a set of balls arranged between said core and said ring, said core fixed rigidly to said pipe, and said ring being rigidly fixed to a frame.

12. A watch according to claim 10, the watch movement including a chronograph type mechanism with a chronograph gear train with a third wheel set for the seconds, formed by said third wheel set.

13. A watch according to claim 12, wherein said third wheel set for the seconds completes one revolution per minute and further includes:

a coupling device capable of occupying a first position and a second position, fitted with an intermediate wheel and kinematically connecting said wheel set for the second to said second wheel set when said coupling device occupies said second position, and control means for moving said coupling device from one of said first and second positions to the other position.

14. A watch according to claim 10, wherein said second wheel set moves with a greater angular velocity than said first wheel set.

15. A watch according to claim 14, including a chronograph type mechanism with a chronograph gear train including a third wheel set for the seconds, formed by said third wheel set.

16. A wristwatch movement with reduced friction, the movement manufactured by the process of:

providing a gear train including a wheel set mounted on a train bridge parallel to a plane and including a cannon pinion friction mounted on said wheel set along an axis perpendicular to said plane, said cannon pinion including a shank at its tip to receive a first hand; and providing a pipe disposed coaxially with said shrank to receive a second hand, said pipe fittingly mounted on a ball bearing to rotate freely on said cannon pinion inside the wristwatch.

17. A wristwatch movement according to claim 16, wherein said ball bearing includes a core, a ring and a set of balls arranged between said core and said ring, said core fixed rigidly to said pipe, and said ring being rigidly fixed to a frame.

18. A wristwatch movement according to claim 16, the movement including a chronograph type mechanism with a chronograph gear train with a third wheel set for the seconds, formed by said third wheel set.

19. A wristwatch movement according to claim 18, wherein said third wheel set for the seconds completes one revolution per minute and further includes:

a coupling device capable of occupying a first position and a second position, fitted with an intermediate wheel and kinematically connecting said wheel set for the seconds to said second wheel set when said coupling device occupies said second position, and control means for moving said coupling device from one of said first and second positions to the other position.

20. A wristwatch movement according to claim 16, wherein said second wheel set moves with a greater angular velocity than said first wheel set.

* * * * *